US010662729B2

(12) United States Patent
Abou-Assaad et al.

(10) Patent No.: US 10,662,729 B2
(45) Date of Patent: May 26, 2020

(54) SLIDING SUBSEA ELECTRONICS MODULE CHASSIS

(71) Applicant: Hydril USA Distribution LLC, Houston, TX (US)

(72) Inventors: Amine Mounir Abou-Assaad, Houston, TX (US); Adam Pickering, Houston, TX (US); Jochen Schnitger, Houston, TX (US); James Richeson, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 16/119,426

(22) Filed: Aug. 31, 2018

(65) Prior Publication Data

US 2020/0072011 A1 Mar. 5, 2020

(51) Int. Cl.

| | |
|---|---|
| ***E21B 33/035*** | (2006.01) |
| ***E21B 41/04*** | (2006.01) |
| ***E21B 33/064*** | (2006.01) |
| ***E21B 33/06*** | (2006.01) |

(52) U.S. Cl.
CPC ..... *E21B 33/0355* (2013.01); *E21B 33/064* (2013.01); *E21B 41/04* (2013.01); *E21B 33/062* (2013.01)

(58) Field of Classification Search
CPC .... E21B 33/0355; E21B 33/064; E21B 41/04; E21B 33/062
See application file for complete search history.

(56) References Cited

U.S. PATENT DOCUMENTS

| | | | | |
|---|---|---|---|---|
| 4,661,017 | A * | 4/1987 | Wood | E21B 43/013 405/169 |
| 6,644,410 | B1 * | 11/2003 | Lindsey-Curran | E21B 33/0355 166/338 |
| 2006/0037758 | A1 * | 2/2006 | Reynolds | E21B 33/035 166/368 |
| 2009/0194290 | A1 * | 8/2009 | Parks | E21B 33/0355 166/339 |
| 2009/0303687 | A1 * | 12/2009 | Davis | E21B 33/0355 361/752 |
| 2013/0213660 | A1 * | 8/2013 | Misuraca | E21B 33/035 166/339 |
| 2016/0076331 | A1 * | 3/2016 | Kalinec | E21B 33/06 166/363 |

OTHER PUBLICATIONS

International Search Report and Written Opinion dated Sep. 27, 2019 in corresponding PCT Application No. PCT/US2019/048271.

* cited by examiner

*Primary Examiner* — James G Sayre
(74) *Attorney, Agent, or Firm* — Hogan Lovells US LLP

(57) ABSTRACT

A subsea electronics module (SEM) is disclosed. The SEM includes a first axis and a second axis, the first axis being longer than the second axis. Electronic modules are mounted on at least one movable platform which is aligned to move in a direction of the first axis of the SEM. External electrical outlets are mounted on a body and along the first axis of the SEM. The external electrical outlets provide electronic coupling between the electronic modules and components of a lower marine riser package (LMRP).

20 Claims, 8 Drawing Sheets

PRIOR ART

PRIOR ART

SLIDING SUBSEA ELECTRONICS MODULE CHASSIS

BACKGROUND

1. Field of Invention

This disclosure relates in general to oil and gas equipment, and to a subsea electronics module (SEM) for use in oil and gas equipment. In particular, the disclosure provides systems and methods for a sliding SEM that is aligned with its longest axis perpendicular to a riser passing through a lower marine riser package (LMRP) comprising the SEM.

2. Related Technology

Blow-out preventer (BOP) systems are hydraulically-controlled systems used to prevent blowouts from subsea oil and gas wells. Subsea BOP equipment typically includes a set of two or more redundant control systems with separate hydraulic pathways to operate a specified BOP function on a BOP lower stack. The redundant control systems are commonly referred to as blue and yellow control pods. A communications and power cable sends information and electrical power to an actuator with a specific address. The actuator in turn moves a hydraulic valve, thereby opening a fluid path to a series of other valves/piping to control a portion of the BOP.

Power and communications connections have been centralized on the control pods subsea. Each control pod may include a subsea electronics module (SEM) with included electronic modules attached to the SEM for handing power requirements of the solenoids and various other components of a lower marine riser package (LMRP). However, maintenance and repair of such SEMs require heavy equipment to remove the SEM completely from the LMRP prior to removing the electronic modules for any work to be performed. Moreover, as the SEM is configured as a vertically mounted cylinder, the removal process is time consuming, error prone, dangerous, and may result in damage to the electronic modules in the process.

SUMMARY

Embodiments of the present disclosure resolve the above identified issues of the SEM and BOP assembly using a novel configuration of the SEM. In an example, a blow-out preventer (BOP) is disclosed as including a BOP lower stack and a lower marine riser package (LMRP). The LMRP further includes the SEM having a first axis and a second axis. The first axis is longer than the second axis. In a particular example, such an SEM may be configured as a hollow cylinder. The SEM is mounted in the LMRP with the first axis being perpendicular to a direction of a riser passing through the BOP. As such, an example application herein is for a horizontally-mounted cylinder that functions as the SEM and includes the electronic modules for controlling or providing signals for various components of the LMRP and the BOP. The horizontally-mounted cylinder is so-called because the cylinder is placed on its body in the assembly with the LMRP and its faces are along its longest axis to provide ease of access to the electronic modules within the horizontally-mounted cylinder.

In another example, a subsea electronics module (SEM) is disclosed. The SEM includes a first axis and a second axis, the first axis being longer than the second axis. Electronic modules mounted on at least one movable platform or chassis aligned to move in a direction of the first axis of the SEM. External electrical outlets mounted on a body and along the first axis of the SEM. The external electrical outlets provide electronic coupling between the electronic modules and components of a lower marine riser package (LMRP).

In yet another example, a method of interfacing a subsea electronics module (SEM) with a lower marine riser package (LMRP) is disclosed. The method includes providing the SEM with a first axis that is longer than its second axis. In a further aspect, electronic modules are provided to be mounted on at least one movable platform or chassis are aligned in the direction of the first axis. The method also includes fixing the SEM to the LMRP with the first axis aligned perpendicular to a riser passing through the LMRP. This at least provides the aforementioned ease of access to resolve the issues of the vertically mounted SEMs. The method then requires moving the at least one movable platform in the first axis to complete electrical coupling from the electronic modules to electrical outlets on a body of the SEM. This electrical coupling may be performed while maintaining the SEM fixed to the LMRP.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION OF THE DISCLOSURE

So that the manner in which the features and advantages of the embodiments for a horizontally mounted SEM and methods, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
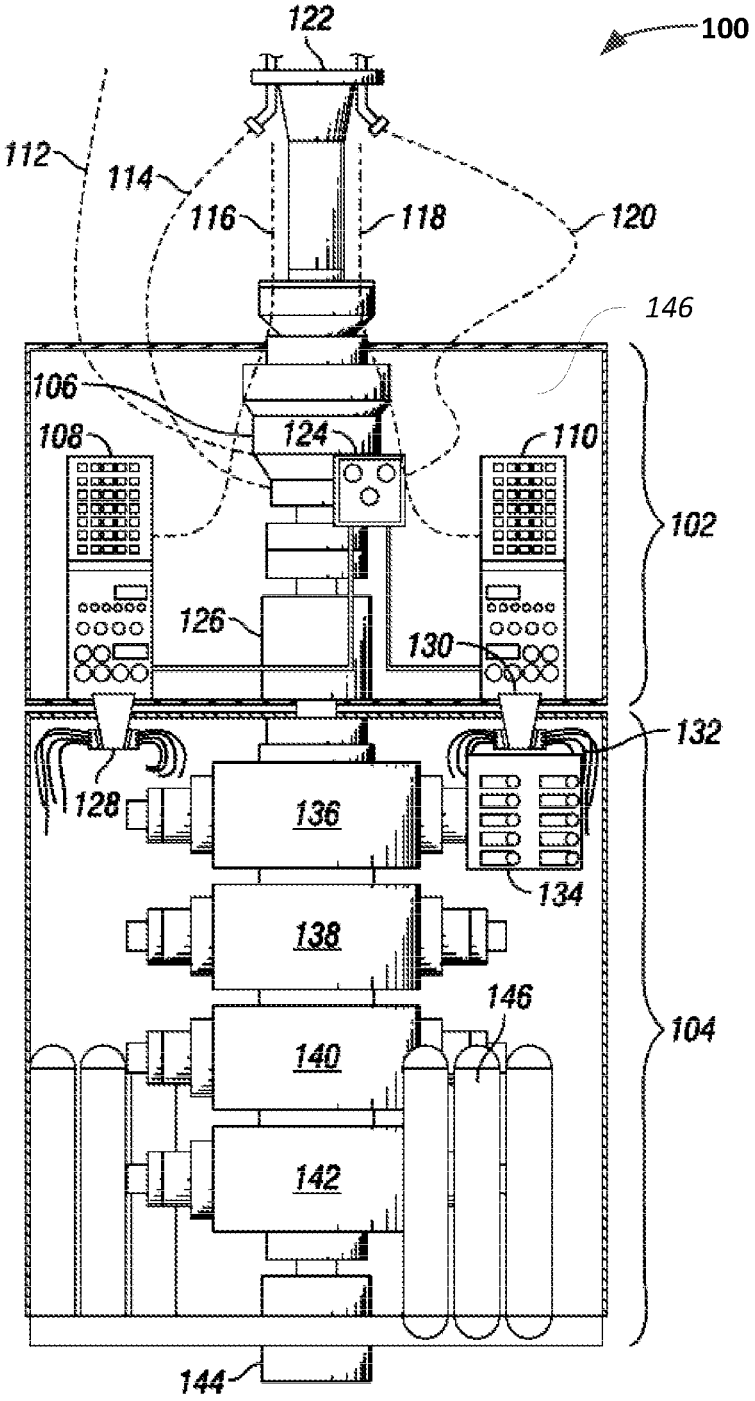
FIG. 1 is a representative system overview of a BOP lower stack and LMRP.

FIG. 1 is a representative system 100 that is an overview of a BOP stack 102, 104 including a BOP lower stack 104 and BOP upper stack or the lower marine riser package (LMRP) 102. A person of ordinary skill would recognize that there may be additional components included in the BOP stack 102, 104, and that the representative system 100 is merely exemplary. LMRP 102 includes an annular 106, a blue control pod 108, and a yellow control pod 110. A hotline 112, a blue conduit 114, and a yellow conduit 120 proceed downwardly from a riser 122 into LMRP 102 and through a conduit manifold 124 to control pods 108, 110. A blue power and communications line 116 and a yellow power and communications line 118 proceed to control pods 108, 110, respectively. An LMRP connector 126 connects LMRP 102 to lower stack 104. Hydraulically activated wedges 128 and 130 are disposed to suspend connectable hoses or pipes 132, which can be connected to shuttle panels, such as shuttle panel 134.

Lower stack 104 can include shuttle panel 134, as well as a blind shear ram BOP 136, a casing shear ram BOP 138, a first pipe ram 140, and a second pipe ram 142. BOP lower stack 100 is disposed above a wellhead connection 144. Lower stack 104 can further include optional stack-mounted accumulators 146 containing a necessary amount of hydraulic fluid to operate certain functions within BOP lower stack 100. The blue and yellow control pods 106, 108 is a subsea component that may include two SEMs, a subsea transformer, solenoids, and subsea hydraulic control valves and regulators. Each of the SEMs and the subsea hydraulic control valves and regulators are considered major subsystems of the blue and yellow control pods 106, 108. The SEMs, apart from providing power, also support collection and transmission of data (e.g., pressure, temperature, flow rate, and ram position) to the surface control subsystem, as well as the electric actuation of subsea hydraulic control valves (also referred to herein as pilot valves) through the solenoids. The two SEMs may be two fully redundant SEM units within each of the blue and yellow control pods 106, 108. In addition, subsea hydraulic control valves and regulators can include shuttle valves, lines, SPM valves, and accumulator bottles. The accumulator bottles provide the hydraulic fluid/pressure necessary to actuate a BOP.

FIG. 1 also depicts that the LMRP 102 can be releasably connected to the BOP lower stack 104 by a hydraulic connector. Also located at the interface between the LMRP 102 and BOP lower stack 104 are components such as wedges, connectors for choke and kill (C&K) lines, and electric and hydraulic stabs. These components allow disconnection and then subsequent reconnection of components, such as the cables, the C&K lines, and the electric and hydraulic lines for circumstances where the LMRP 102 is released and removed from the BOP lower stack 104 and then reattached. Such a scenario may occur, for example, where a hurricane or other conditions necessitate temporary removal of the LMRP 102 from the BOP lower stack 104 to prevent damage to the system. In addition, the LMRP 102 can include, for example, an Remotely Operated Vehicle (ROV) intervention panel, and a C&K subsystem having a C&K flex loop, C&K valves for the C&K lines, a gas bleed valve, and C&K stab connectors. In addition, the LMRP 102 can include an LMRP connector 126, a riser adapter, a flex joint, LMRP High Pressure High Temperature (HPHT) probes, and a power and communication hub. The LMRP 102 can further include an LMRP subsea control module.

According to some embodiments, the BOP lower stack 104 may include a frame that can have a two-point lifting capability, which allows the frame to be split into two parts. In some embodiments, the entire stack 102, 104 can be retrievable from either a horizontal or vertical position, and the frame can have a wellhead connector position indicator to provide easy viewing of the connector operations.

In some embodiments, the BOP lower stack 104 has a three-piece frame design, including a one-piece LMRP 102 and a two-piece lower stack including upper and lower portions. Various BOPs 136-142 are attachable to individual rather than multiple levels of the frame, allowing the BOP lower stack 104 to be split without removing all the BOPs. Additionally, hydraulic manifolds are provided at each level of the frame; this allows sections of piping to be readily attached to the manifolds when the frame is assembled, simplifying installation and maintenance operations. The three-piece design also facilitates transportation of the BOP lower stack 104 components from the site of manufacture to the drill ship or platform.

In some embodiments, the BOP lower stack 104 is configurable as a 6, 7, or 8 cavity stack. When desired by the user, the configuration can be modified in the field after initial deployment. The BOP lower stack 104 may include modular components which allow double BOPs to be exchanged with single BOPs and vice versa, depending on the needs of the user. Configurability of the stack 102, 104 enables a user to add or subtract BOPs based upon the needs of each wellsite, such as for reasons related to weight, the specific subsea wellhead being used (e.g., 15 ksi or 20 ksi), etc. Because the stack is modular and includes strategically placed connections, in order to replace a damaged or worn BOP, a user can swap a portion of the stack, rather than pulling apart the entire stack, thus reducing down time.

FIG. 1 also illustrates that the LMRP 102 includes a frame 146 around the components 106, 108, 110, 134, 126, and 130. The frame 146 may be designed to include these components of the LMRP 102 in a removable manner. In embodiments, the frame 146 can be a fabricated steel frame painted with a three part epoxy subsea coating. In addition, the frame can include yoke type hangoff beam supports, and one ladder can be included to provide access to the top of the pedestal. In some cases, the pedestal can include padeyes, which can interface with crane lifting blocks. The frame 146 of the LMRP 102 can be designed to support the mounting of acoustic sensors for monitoring the annulars; e.g., annular 106.

The ROV intervention panel is designed to allow an ROV to perform multiple functions on the LMRP 102. A person of ordinary skill would recognize that the present illustration of FIG. 1 includes the ROV intervention panel on the front of the control pods 108, 110. The functions carried out by an ROV may be as a backup, when the surface controls are not functioning properly. Through the ROV intervention panel, the ROV can carry out some or all of at least the following functions, including LMRP connector primary unlock, LMRP connector secondary unlock, LMRP connector Glycol Flush, All stabs retract, LMRP gasket retract, Inner and outer bleed valves open, Riser connector primary and secondary unlock, Rigid conduit flush isolation valve, Solenoid pilot dump, and LMRP connector POCV by-pass. The ROV intervention panel can be constructed of stainless steel with ROV grab bars, and ROV stabs.

To disconnect the LMRP 102 from the BOP lower stack 104, the C&K connector can be first retracted by applying hydraulic pressure to a "Retract Port" on a female stab connection before disconnecting the LMRP connector 126. However, should the retract function fail to operate before the disconnecting the LMRP 102, the C&K connector may not prevent the disconnection of the LMRP 102 from the BOP lower stack 104. In some embodiments, the female stab connection can have a snap ring "detent" to help maintain the female stab in the "Extended" or "Retracted" position when hydraulic pressure or bore pressure is not present.

Figure 2:
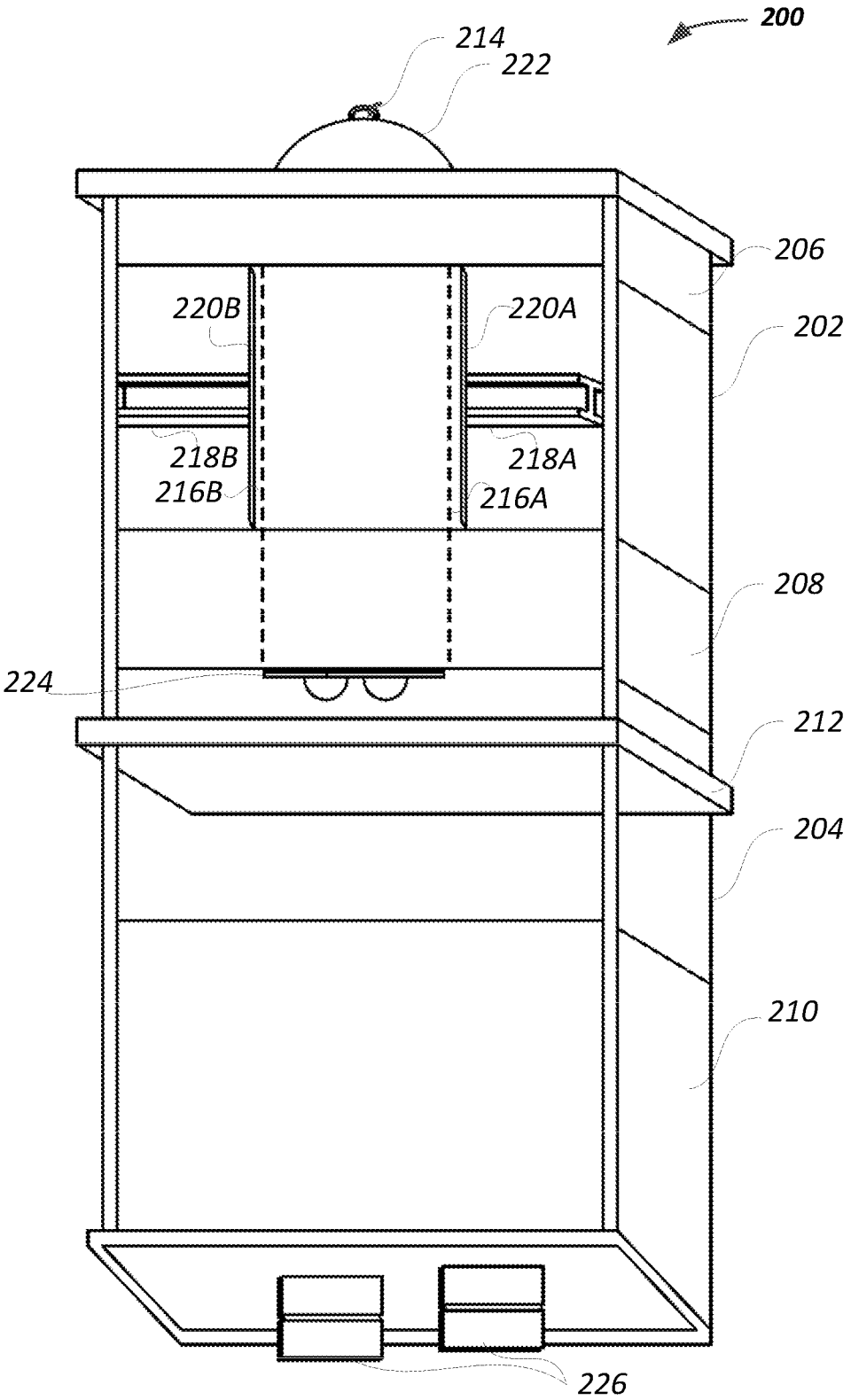
FIG. 2 illustrates an example control pod including a vertical SEM mounted therein.

FIG. 2 illustrates an example control pod 200 including a vertical SEM mounted therein. The SEM 222 is mounted such that its longest axis follows a longitudinal axis of riser 122 in FIG. 1. In effect, a longest axis of the SEM 222 is parallel with the longest axis of the riser 122. In this example, the SEM 222 is a cylinder shaped container with a detachable dome and a handle 214 for removal of the SEM 222 from the control pod 200. An upper end of the LMRP 102 (in FIG. 1) is connected to the riser 122 that extends from the upper end of the LMRP 102 to a vessel at the surface of the sea. The SEM 222, therefore, also has its longest axis perpendicular to the surface of the sea, making its orientation vertical in reference to the surface of the sea. Example control pod 200 may be a first control pod (often referred to as the yellow control pod) or a second control pod (often referred to as the blue control pod). In the embodiment shown in FIG. 1, the first and second control pods are illustrated as in LMRP 102. The first control pod 108 and second control pod 110 can be controlled by controls located on the vessel. The vessel can be any appropriate vessel, including, for example, a drill ship or a platform.

In operation, the subsea BOP rams of BOPs 136-142 are hydraulically controlled by the first or second pod 108, 110. For example, hydraulic lines 132 run from each of the first and second control pods 108, 110 to individual rams 136-142 of the BOP lower stack 104. One of the two control pods 108, 110 may be responsible to hydraulically control the rams through its respective hydraulic lines, while the other control pod remains idle. In this way, redundancy is built into the system because, when the control pod actually controlling the rams becomes incapacitated, or otherwise requires maintenance or replacement, the other control pod can continue operation of the rams. In an embodiment, receivers in the BOP lower stack 104 can be constructed of, for example, galling and corrosion resistant stainless steels. The BOP receivers can be spring-loaded, and can be bolted to a welded companion flange on the bottom of the BOP plate. The receiver can also provide function ports for the BOP hydraulic components.

In FIG. 2, the example control pod 200 includes a section 206 for accumulators, a section 208 for solenoids, and a section 210 for pod valves and regulators. In the example control pod 200, the sections 206, 208, and 210 are marked on one side of the control pod 200, but a person of ordinary skill would understand upon reading this disclosure that the sections 206, 208, and 210 may be on all four sides, within the frame, of the control pod 200. The example control pod 200 is also illustrated to include separable portions 202 and 204, where portion 202 includes the electronic controls and portion 204 includes the hydraulic controls. As such, a separator 212 may be built of a similar framing material as referred in the discussion of the frames in FIG. 1. In addition, the cylindrical SEM 222 may be positioned using an assembly of support bars 218A, 218*b*, and of vertical bars 220A, 220B. The SEM 222 may be hoisted using handle 214, by a crane, out of the control pod 200 for servicing. The process is challenging and time consuming, and may, sometimes, result in damage to the electronic modules with the SEM 222 or to external connectors 224 located on the lower face of the SEM 222. For example, movement of the SEM 222 (illustrated as behind the sections 208 and 206 by broken lines 216A, 216B) may cause parts of the SEM 222 to contact support bars 220A, 220B, which may cause damage. In addition, the weight of the SEM 222 and its bottom connectors or couplers 224 are such that the removal process involves considerable time and requirement for precision movement of the crane. LMRP stringers 226 are also illustrated in FIG. 2 to provide physical connection to the BOP lower stack.

Figure 3:
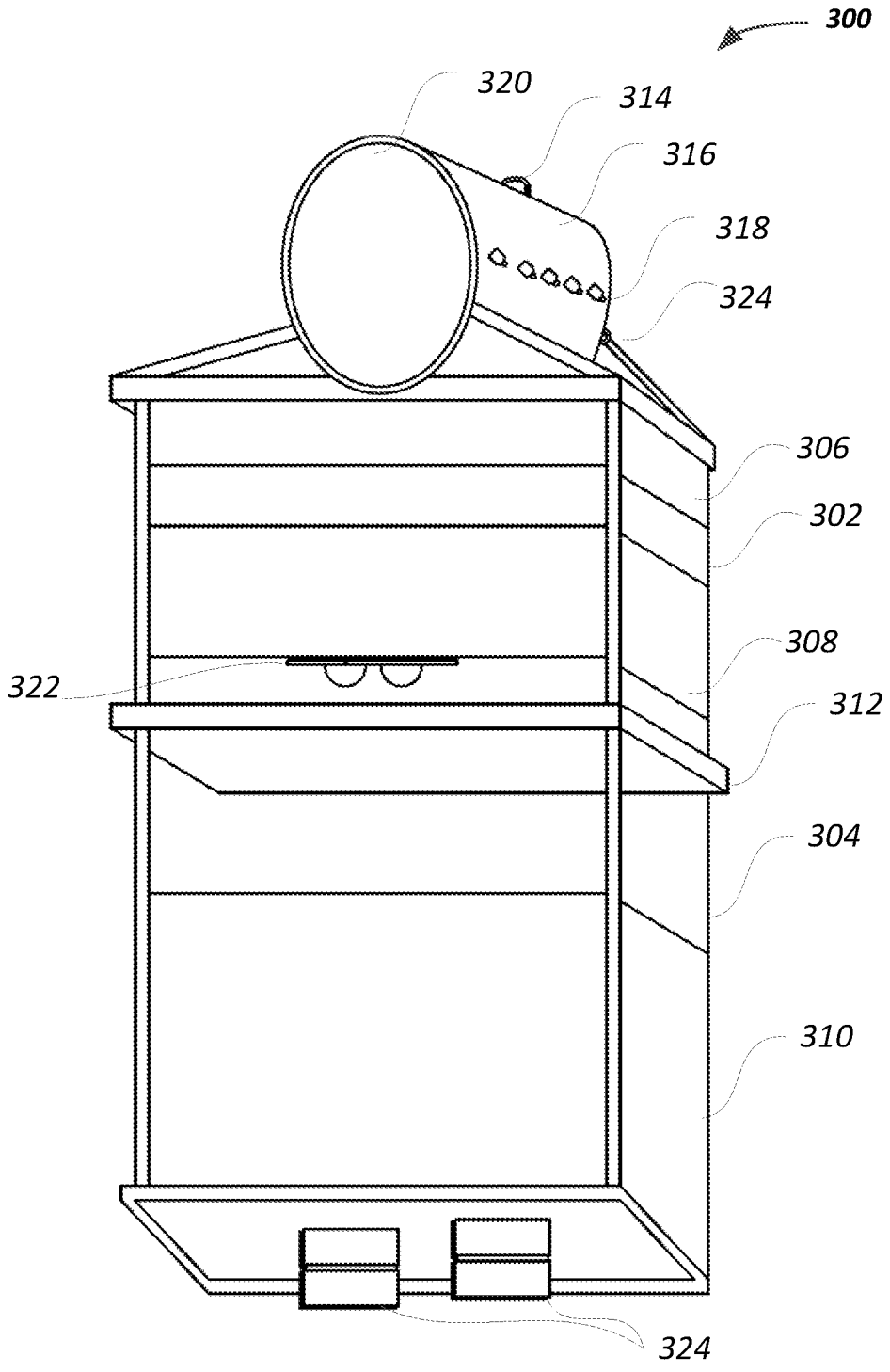
FIG. 3 illustrates an example control pod including a horizontal SEM mounted therein.

FIG. 3 illustrates an example control pod 300 of a horizontal SEM 316 mounted therein. As in the case of FIG. 2, there are multiple portions to this example control pod 300, including separable portions 302 and 304, where portion 302 includes the electronic controls and portion 204 includes the hydraulic controls. As such, a separator 312 may be built of a similar framing material as referred in the discussion of the frames in FIG. 1. In addition to the portions 302, 304, there are also sections 306, 308, and 310 within these sections for various components of the control pod as in the case of the example control pod 200. For example, section 306 may be assigned for accumulators, a section 308 for solenoids, and a section 310 for pod valves and regulators. In the example control pod 300, the sections 306, 308, and 310 are marked on one side of the control pod 200, but a person of ordinary skill would understand upon reading this disclosure that the sections 306, 308, and 310 may be on all four sides, within the frame, of the control pod 300. LMRP stringers 324 are also illustrated in FIG. 3 for similar functions as in the case of FIG. 2—e.g., to provide physical connection to the BOP lower stack. Additional connectors or couplers 322, for electronic coupling, are available between the portions 302, 304. The additional connectors or couplers 322 may be fixed or releasable with the portion 302, and have one side coupled with the external electrical connectors or couplers 318 that are provided on the body of the horizontal SEM 316. These connectors or couplers 322 also allow for detachment of the portion 302 from portion 304 of the control pod 300. In an alternate aspect, the external electrical connectors or couplers 318 that are provided on the body of the horizontal SEM 316 directly couple to electrical connectors or couplers of the portion 304 of the example control pod 300.

As illustrated in FIG. 3, the SEM 316 is easy to access in the horizontal position with its longest axis perpendicular to a longest axis of a riser running through the LMRP hosting the control pod 300. Indeed, as such, the SEM 316 is horizontal to the sea surface in implementation. The SEM 316 is also illustrated in a cylindrical form factor with a handle on an axial body of the SEM 314, instead of the face 320. Although, face 320 may include a handle for a human or machine operator to open the door underlying face 320 to access the SEM 316, the handle 314 may be used for hoisting the SEM 316 to any other area for further maintenance. However, as FIG. 3 illustrates, the SEM 316, in the horizontal position, is easily accessible by opening the door underlying face 320 without a requirement to remove the SEM 316 from the connection with the remainder portions 302, 304 of the control pod 300. In addition, external electrical connectors or couplers 318 are provided on the body, along the longitudinal or longest axis of the SEM 316 for coupling the SEM 316 to components in the portions 302, 304 or the LMRP, generally. FIG. 3 also illustrates fixtures 324 on the SEM body for mounting the SEM in an LMRP, such that the first axis of the SEM is perpendicular to a direction of a riser passing through the LMRP. The fixtures 324 may include bolt holes, flange holes, and welded flanges.

Figure 4:
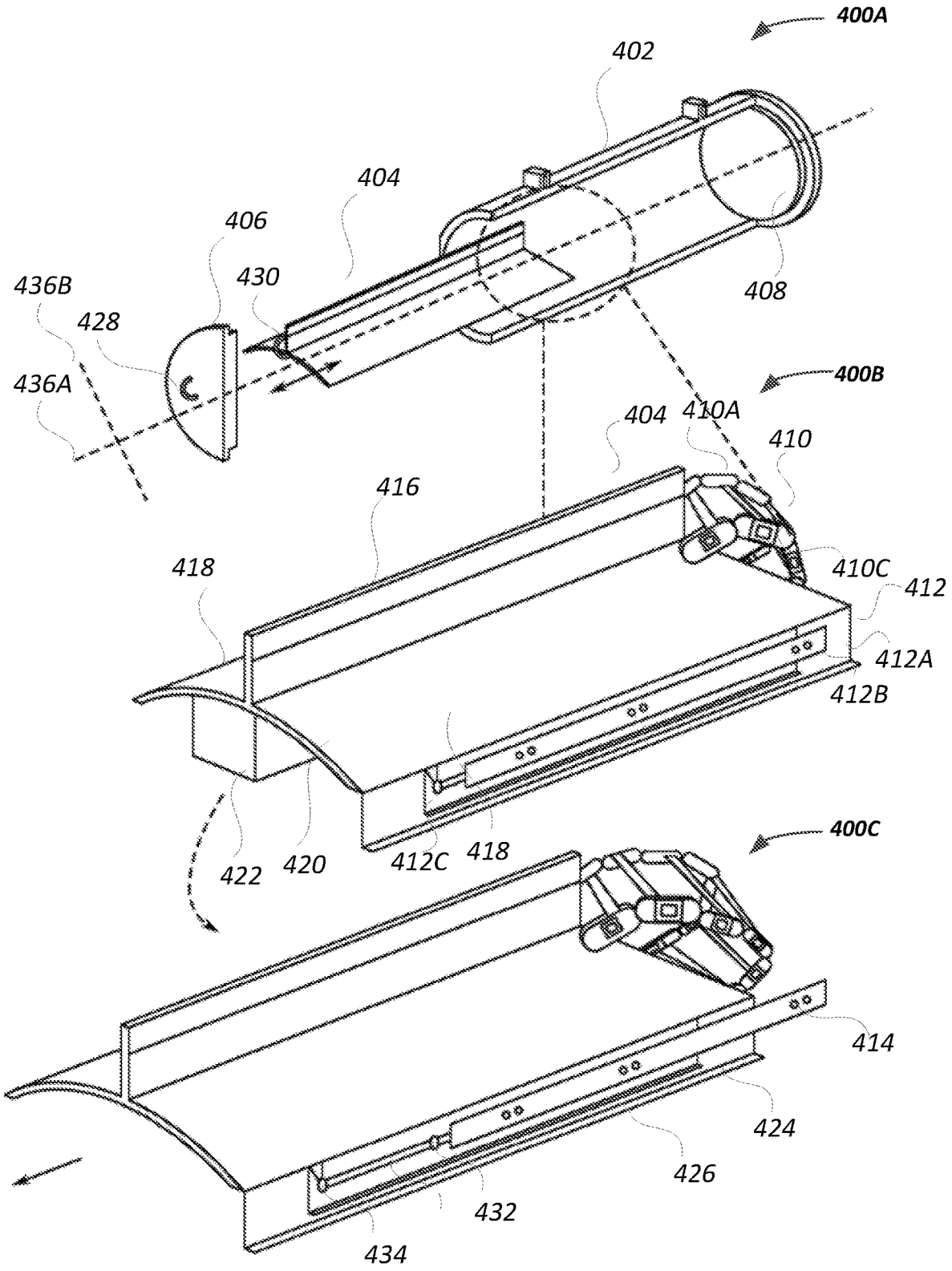
FIGS. 4, 5A, 5B, 5C, and 6 are illustrations of example features and configurations of a horizontal SEM.

FIGS. 4, 5A, 5B, 5C, and 6 are illustrations of example features and configurations of a horizontal SEM. FIG. 4 illustrates internal features and configurations 400A, 400B, and 400C that enable the horizontal SEM with a sliding chassis for electronic modules. In the example of FIG. 4, an SEM body 402 is illustrated as a cylinder having a longer axis 436A (longitudinal axis along the length of the cylinder) compared to shorter axis 436B (transverse axis along the width or diameter of the cylinder). The positioning of the SEM of FIG. 4 on a control pod is such that the longer axis 436A is perpendicular to a riser of an LMRP hosting the control pod. As such, the internal components of the SEM of FIG. 4 may be accessed by opening the door 406 using handle 428 or other operative mechanism, such as a latch or a holder. When the door 406 is opened, at least one movable or detachable platform or chassis 404 is presented. The at least one movable or detachable platform or chassis 404 may be an integrated platform of different hosting faces attached together or may be a single unibody structure. The chassis, as used herein, refers to the at least one movable platform 404, but may include one or more additional components or features that enable the at least one movable platform 404. The moveable platform 404 may include its open handle 430 or other operative mechanism to withdraw the moveable platform 404 from the SEM.

FIG. 4 illustrates further internal features and configurations of the movable platform 404, including horizontal surfaces 418 and a vertical surface or fin 416, in various stages of removal from a horizontal SEM. Each of the horizontal surface 418 and the vertical surface 416 may include sockets or interior connectors to receive electronic modules for serving one or more typical functions for the SEM to function in an expected manner. Furthermore, the sockets or interior connectors provide electrical coupling using a fixed connector portion 422 that may be detachably fixed to the bottom of the SEM. Furthermore, the fixed connector portion 422 is in electrical or communicative coupling with external electrical couplers or connectors using the example features of FIG. 5B, for instance. The communicative coupling may be electrical coupling.

FIG. 4 also illustrates a flexible track 410, which is attached, directly or indirectly at its proximal end, to the movable platform 404. In an example, the flexible track 410 is a metal rail assembly with counterpart movable plates 410A, 410B fixed together with a pin 410C or other similar operative mechanism. A distal end of the flexible track 410 may be fixedly or detachably connected to the fixed connector portion 422 at the bottom of the SEM. In operation, when the handle 430 is pulled (or automatically activated to move the movable platform 404), the chassis or movable platform 404 is moved, along the longitudinal or longest axis of the SEM, towards the exterior of the SEM body 402. The flexible track 410 extends along with the movable platform 404 in the direction of the movement. The movement from within the SEM body to the fully or partially exterior of the SEM body is illustrated between the configurations in 400B and 400C.

FIG. 4 also illustrates a telescopic slider 412, which may be attached to an inner body portion of the SEM. The telescopic slider may include one or more slider parts 412A, 412B, and 412C, each with guides 424, 426 to guide some of the slider parts 412A, 412B, and 412C that move relative to each other. The slider parts may be referred to herein as rails. Particularly, while slider part 412B may be fixed to the inner body portion of the SEM using rivets or another similarly operative mechanism 414, the slider parts 412A and 412C move relative to each other. These sliders may be seen as guide rails. Furthermore, even though slider part 412A is described as movable, it may be fixed to the movable platform or chassis 404 causing the movement of the movable platform or chassis 404 along the length of the slider part 412B. For example, rail 412A includes a pin or bolt 432 that slides in a slot 438 till the pin or bolt 432 reaches the end 434. A similar mechanism is found between rail 412C and 412B that allows the movable platform 404 to move relative to the SEM body.

FIG. 4 also illustrates that when the pin or bolt 432 reaches the end 434, the movable platform 404 may be tilted to remove the movable platform from the telescopic slider 412. This may be done by disengaging the pin or bolt 432 from the slot 438 through the opening in the slot at the end 434. Prior or after disengaging the pin or bolt 432 from the slot 438, the flexible track 410 may be decoupled from the coupling with the movable platform 404, at the proximal end of the flexible track 410.

Figure 5A:
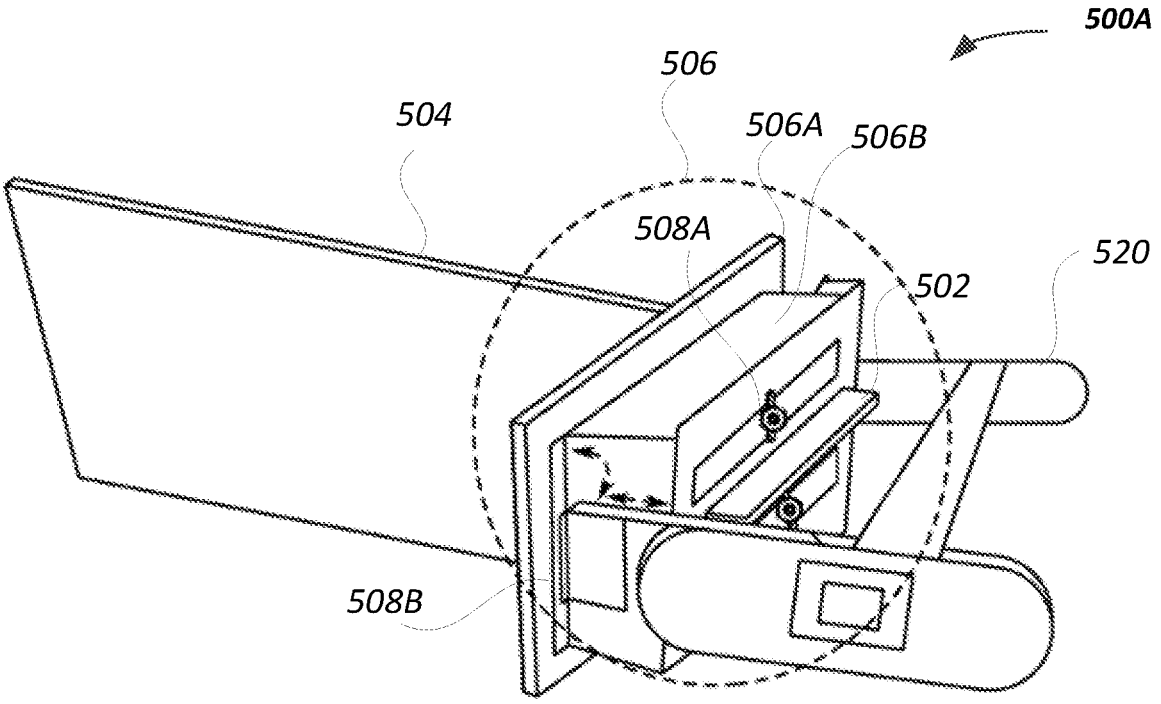

FIG. 5A is an illustration of an example features and configurations 500B 500A of the horizontal SEM. The example feature and configuration 500A build additional detail to some of the example features and configurations 400A, 400B, and 400C. In the example feature and configuration 500A and all the embodiments herein, vertical surface or fin 504 corresponds to the vertical surface or fin 416 of FIG. 4. As used herein, reference to any portion of the movable platform is also reference to the movable platform in its entirety as the vertical surface or fin 504 may be the only movable platform in an implementation. Separately, the horizontal movable platform 418 may not require a vertical surface 416. A person of ordinary skill would understand from this disclosure that these parts are interchangeable or usable independently or together. The coupling, previously described as between the movable platform 404 and the proximal end of the flexible track 410, in FIG. 4, is provided in more detail in FIG. 5A. A coupler assembly 506 includes a frame plate 506A, internal electrical outlets 506B, and a retainer plate 506C. As used herein, the electrical outlets are generally used to refer to outlets for both electrical and communication purposes. The internal electrical outlets 506B may include, one side, any socket configured to receive input from one or more electronic modules on the movable platform 504. In addition, the internal electrical outlets 506B may include, on its other side, any socket 502 configured to receive input from a harness (see e.g., FIG. 5C) connected to exterior electrical outlets, such as those shown in FIG. 5C.

In an alternative implementation, the internal electrical outlets 506B may include only one socket 502 with the electronic modules directly feeding signals to the socket 502. As such, one need not couple two separate sets of connections, so long as the electronic modules are inserted in the movable platform 504, corresponding electrical signals may be provided to the socket 502. FIG. 5 also illustrates the use of a locking mechanism 508A, 508B to physically couple the flexible track 520 to the retainer plate 506C. As such, the locking mechanism 508A, 508B may be fixedly or releasably attached to the frame plate 506A. In an example, the locking mechanism 508A, 508B may include a bolt and nut, with the bolt placed through the frame plate 506A and a slot in the retainer place, while the nut, being of larger diameter than the slot, holds the bolt in place. In addition, a retainer clip may be used with the bolt and nut to hold the flexible track 520, as well as a harness, in place while the harness is connected in the socket 502. The locking mechanism 508B may be a sliding or rotating latch that is fixed on the frame plate 506A and that is movable to latch into a designated hole or area of the flexible track 520. While the features in FIG. 5A are illustrated on one side of the movable platform 504, a person of ordinary skill reading the present disclosure would recognize that similar and counterpart structure is provided on the other side for symmetrical functioning of the chassis and SEM structure.

Figure 5B:
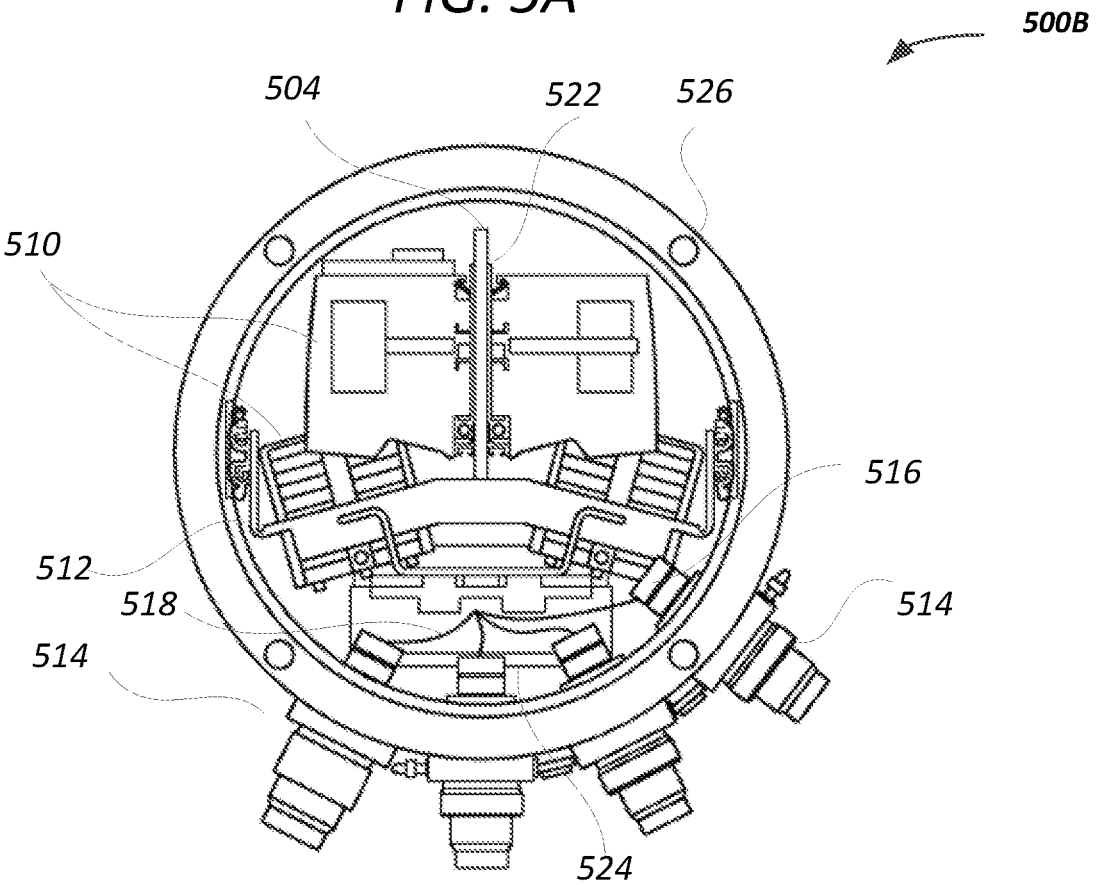

FIG. 5B is an illustration of additional example features and configurations 500B of the horizontal SEM. FIG. 5B may be a cross-section of the SEM body and chassis 400A, along the axis 436A, for instance. The example features and configurations 500B build additional detail to some of the example features and configurations 400A, 400B, 400C, and 500A. In the example feature and configuration 500B, vertical surface or fin 504 corresponds to the vertical surface or fin 416 of FIG. 4. The SEM body 526 is illustrated as including the movable platform 504, 512 within the structure. Electronic modules 510 are illustrated as coupled using latching mechanisms 522 to the vertical surface 504 or horizontal surface 512 of the movable platform. Such latching mechanisms 522 may be a protruding portion against the vertical surface that requires the electronic modules 510 to include a counterpart sunken notch that slides against the protruding portion and that holds the electronic modules 510 in place.

FIG. 5B additionally illustrates a fixed connector portion 524, which was previously discussed with reference to reference numeral 422 of FIG. 4. The fixed connector portion 524 may be fixed to the bottom of the SEM body 526 by any operative fixing mechanisms, including by welding, bolting, or riveting. FIG. 5B also illustrates wiring 518 from a harness coupled, at its proximal end, to an end of the movable platform 504, 512. The wiring 518 couples the interior electrical sockets to the exterior outlets 514. As used herein, the electrical sockets are generally used to refer to sockets for both electrical and communication purposes. Intermediary electrical components 516, such as pass-through sockets, may be used to provide the coupling from the wiring 518 to the exterior sockets 514. As used herein, the intermediary outlets generally refer to outlets for both electrical and communication purposes.

Figure 5C:
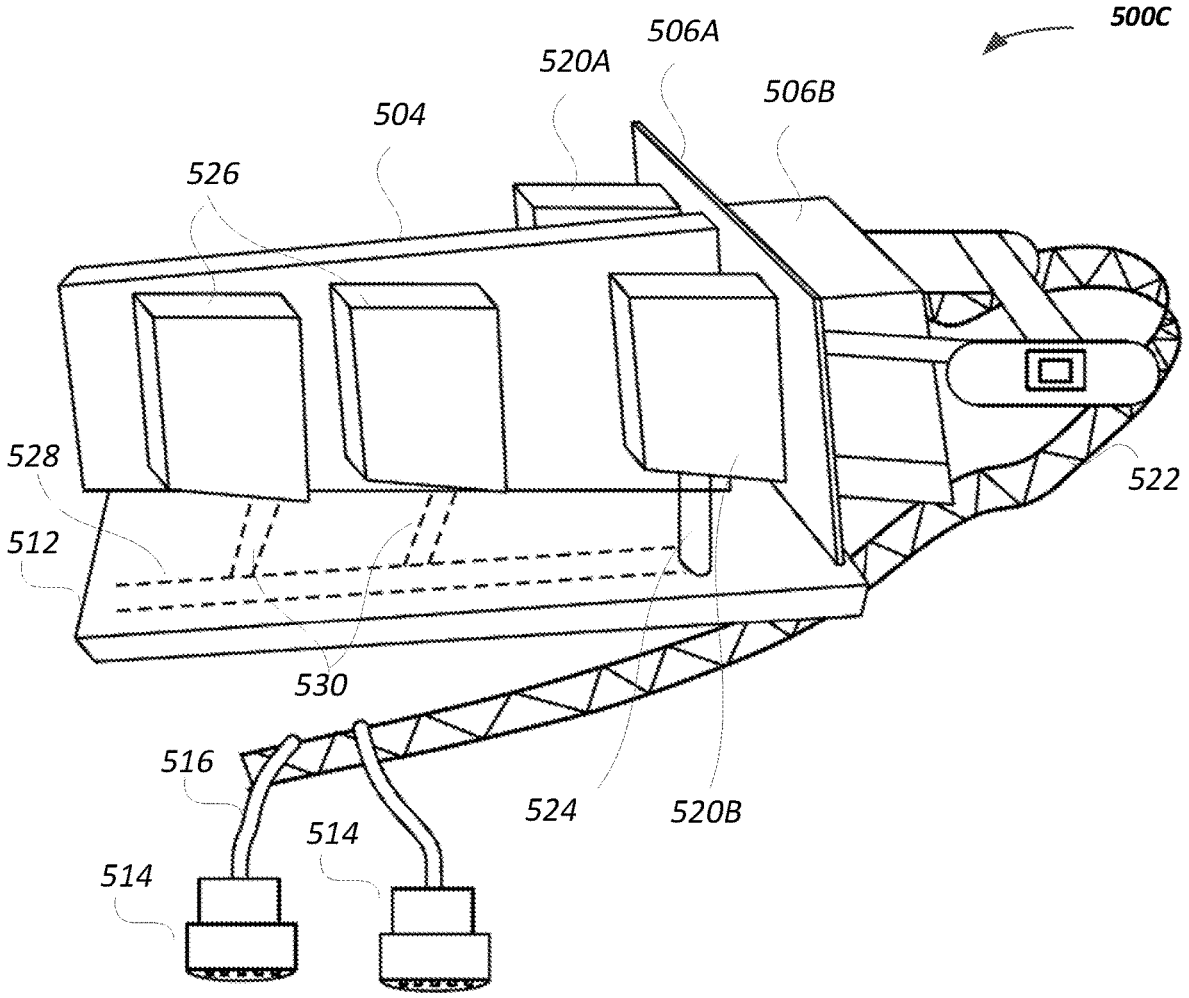

FIG. 5C is an illustration of still further example features and configurations 500C of the horizontal SEM. The example features and configurations 500C build additional detail to some of the example features and configurations 400A, 400B, 400C, 500A, and 500B. In the example feature and configuration 500C, vertical surface or fin 504 corresponds to the vertical surface or fin 416 of FIG. 4. The electronic modules 526 are illustrated in this figure as being coupled to areas of the vertical surface 504. Electrical coupling between the electronic modules 526 and the harness 522 is provided via the plug-in connection 520A, 520B to the internal electrical outlets 506B. Alternatively, the electronic modules 526 directly couple to the internal electrical outlets 506B, without the need for the plug-in connection 520A, 520B. A person of ordinary skill, upon reading the present disclosure, would recognize that such an implementation is possible by reconnecting the wires 528 and sub-connections 530 directly to the internal electrical outlets 506B. Furthermore, FIG. 5C illustrates that the harness, at a distal end of the harness or the flexible track, provides connectors 516 for the exterior electrical outlets 514.

Figure 6:
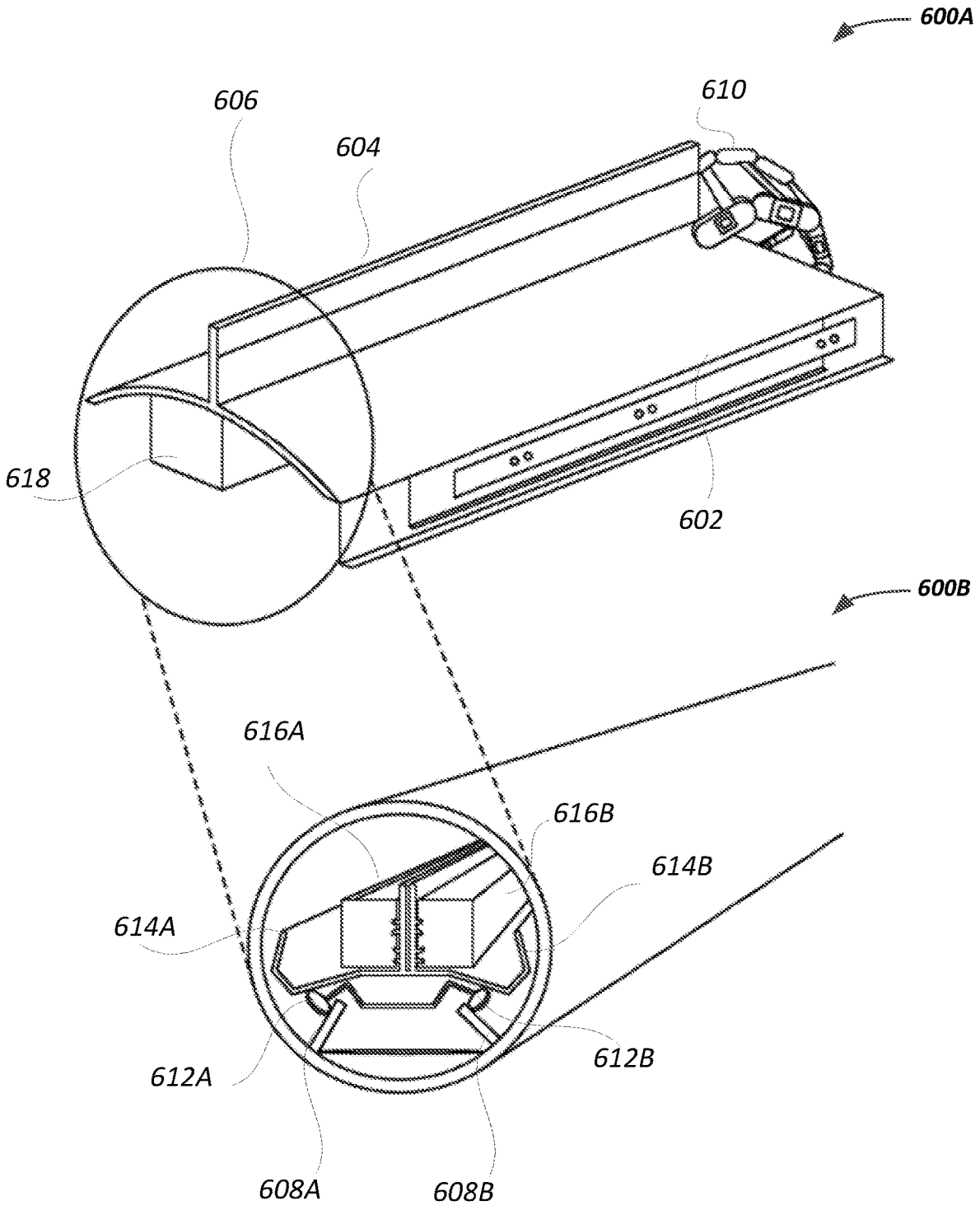

FIG. 6 is an illustration of still further example features and configurations 600A, 600B of the horizontal SEM. The example features and configurations 600A, 600B build additional detail to some of the example features and configurations 400A, 400B, 400C, 500A, 500B, and 500C. In the example features and configurations 600A, 600B, vertical surface or fin 604 corresponds to the vertical surface or fin 416 of FIG. 4 and horizontal surface 602 corresponds to vertical surface 418 of FIG. 4. Flexible track 610 is illustrated as connected to an end of the movable platform as previously discussed. FIG. 6 provides an additional or an alternative implementation to the telescopic slider of FIG. 4. For example, FIG. 6 illustrates portion 606 of the movable platform as including a rolling mechanism 612A, 612B that may be affixed to the fixed connector portion 618 of the SEM. The fixed connector portion 618 corresponds to fixed connector portion 524 of FIG. 5B and fixed connector portion 422 of FIG. 4. The movable platform 604 includes wings 614A, 614B, which, along with the horizontal surface 602 provides tracks for aligning the movable platform 604 to the rolling mechanism 612A, 612B. FIG. 6 illustrates the use of fixed rail structures 608A, 608B to support the wheels while the movable platform rolls over it. As such, the example features and configurations 600B may be used with or without the telescopic slider of FIG. 4. In both instances, a movement is achieved in the horizontal direction (or longitudinal axis) of the SEM. FIG. 6 also illustrates the electronic modules 616A, 616B that are detachably attached to the vertical surface 604.

Figure 7:
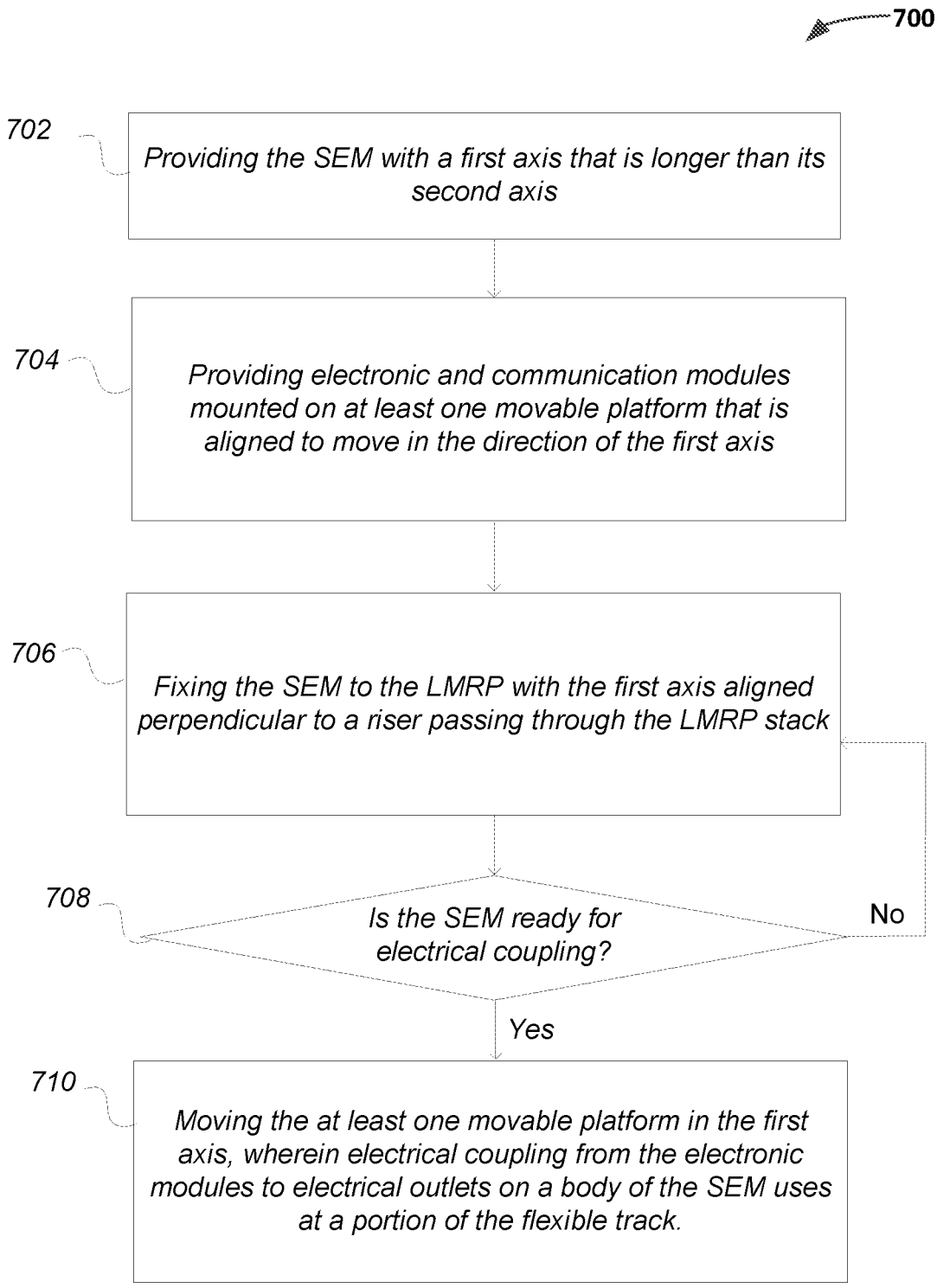
FIG. 7 is a flowchart illustrating an example method of interfacing a subsea electronics module (SEM) with a lower marine riser package (LMRP).

FIG. 7 is a flowchart 700 illustrating an example method of interfacing a subsea electronics module (SEM) with a lower marine riser package (LMRP). In step 702, the method includes providing the SEM with a first axis that is longer than its second axis. Such an implementation may be by providing a cylindrical SEM structure configured with sealing capability to ensure 1 atmosphere of relative pressure—at the surface of the sea—is maintained when the SEM is closed and submerged to its operational level. In the alternative, a relative pressure at the surface of the sea is maintained within the cylindrical SEM structure by the sealing offered once the chassis is in place. The relative pressure is because the surface pressure is sealed into the SEM structure once the doors are sealed closed. The method includes step 704 for providing electronic and communication modules mounted on at least one movable platform are aligned in the direction of the first axis. Step 706 then fixes the SEM to the LMRP with the first axis aligned perpendicular to a riser passing through the LMRP. In the case of the cylindrical SEM, the SEM is set on its side, with its longitudinal axis perpendicular to the riser in the LMRP. Step 708 verifies that the SEM is properly position for electrical coupling. Once the verification is confirmed, then step 710 is implemented to move the at least one movable platform in the first axis to complete electrical coupling from the electronic and communication modules to electrical outlets on a body of the SEM. Step 706 may be performed to confirm the alignment of the SEM to the LMRP if required.

The present horizontal sliding chassis enables an efficient use of space for electrical equipment in the SEM. For example, the present technology eliminates a need for the entire SEM to be removed completely from control pod and, even if such removal is required, it could done without endangering personnel. The chassis slides out on the telescopic slider and/or rails for easy maintenance. Such a structure is also lighter and smaller than a vertical SEM and includes simplified manufacturability. Flange connector receptacles (FCRs) may be mounted on a lower half of the SEM body to prevent damage and water ingress. The FCRs can be removed and tested without disturbing other components. The door or endcap of the vertical SEM is easily removable and bolts are not required for pressuring. Further, in an example, the telescopic sliders are heavy-duty slider with a lock-in feature to ensure that the movable platform or chassis stays closed during movement. Lock-out feature may also exist for retaining the movable platform or chassis in an exterior or open position, securely, for extended periods of time.

In the various embodiments of the disclosure described, a person having ordinary skill in the art will recognize that alternative arrangements of components, units, conduits, and fibers could be conceived and applied to the present invention.

The invention claimed is:

1. A blow-out preventer (BOP) comprising:

a BOP lower stack; and a lower marine riser package (LMRP), wherein the LMRP comprises:

a subsea electronics module (SEM) comprising a first axis and a second axis, the first axis being longer than the second axis;

the SEM mounted in the LMRP with the first axis being perpendicular to a direction of a riser passing through the BOP; and a flexible track detachably coupled to at least one movable platform located within the SEM.

2. The BOP of claim 1, wherein the SEM comprises a cylinder shaped container.

3. The BOP of claim 1, further comprising:

a detachable platform within the SEM, wherein the detachable platform comprises electronic and communication modules and wherein the detachable platform is physically and electrically detachable from the SEM while the SEM is attached in the LMRP.

4. The BOP of claim 1, further comprising:

the flexible track detachably coupled to an end of the at least one movable platform in the SEM.

5. A subsea electronics module (SEM) comprising:

a first axis and a second axis, the first axis being longer than the second axis;

electronic and communication modules mounted on at least one movable platform aligned to move in a direction of the first axis of the SEM;

external electrical outlets mounted on a body and along the first axis of the SEM, the external electrical outlets providing external electrical coupling between the electronic and communication modules and components of a lower marine riser package (LMRP); and a flexible track detachably coupled to the at least one movable platform.

6. The SEM of claim 5, further comprising: fixtures on a body of the SEM for mounting the SEM in the LMRP with the first axis being perpendicular to a direction of a riser passing through the LMRP.

7. The SEM of claim 5, further comprising: the flexible track detachably coupled to an end of the at least one movable platform.

8. The SEM of claim 5, further comprising: the flexible track comprising a harness with electrical wiring for coupling between the external electrical outlets at a distal end of the flexible track and at least one socket located at a proximal end of the flexible track.

9. The SEM of claim 5, further comprising: an end of the at least one movable platform comprising a handle to move the at least one movable platform in the direction of the first axis of the SEM and to detach the at least one movable platform from a coupling with a harness of the flexible track.

10. The SEM of claim 5, further comprising: at least one pair of fixed wings mounted to an inside body of the SEM, the at least one pair of wings providing guidance for moving the at least one movable platform.

11. The SEM of claim 5, further comprising: at least one pair of telescopic sliders mounted to an inside body of the SEM, the at least one pair of telescopic sliders providing guidance for moving the at least one movable platform.

12. The SEM of claim 5, further comprising: at least one cover detachably mounted to the SEM to close the SEM at sea surface level, to maintain a relative pressure of 1 atmosphere within the SEM in a subsea environment.

13. A method of interfacing a subsea electronics module (SEM) with a lower marine riser package (LMRP) comprising:

providing the SEM with a first axis that is longer than its second axis;

providing electronic and communication modules mounted on at least one movable platform that is aligned to move in the direction of the first axis, the at least one movable platform being detachably coupled to a flexible track;

fixing the SEM to the LMRP with the first axis aligned perpendicular to a riser passing through the LMRP; and moving the at least one movable platform in the first axis, wherein electrical coupling from the electronic and communication modules to external electrical outlets on a body of the SEM uses at least a portion of the flexible track.

14. The method of claim 13, further comprising: providing fixtures on a body of the SEM for mounting the SEM in the LMRP.

15. The method of claim 13, further comprising: providing the flexible track that is detachably coupled to an end of the at least one movable platform.

16. The method of claim 13, further comprising: coupling internal electrical outlets at a distal end of the flexible track and at least one socket located at a proximal end of the flexible track using a harness comprising electrical wiring.

17. The method of claim 13, further comprising: detaching the at least one movable platform from a coupling with a harness of the flexible track using a handle located at an end of the at least one movable platform, thereby removing the at least one movable platform in the direction of the first axis of the SEM.

18. The method of claim 13, further comprising: guiding a movement of the at least one movable platform using a pair of fixed wings mounted to an inside body of the SEM.

19. The method of claim 13, further comprising: guiding a movement of the at least one movable platform using a pair of telescopic sliders mounted to an inside body of the SEM.

20. The method of claim 13, further comprising: maintaining a relative pressure of 1 atmosphere within the SEM in a subsea environment using a cover detachably mounted to the SEM by closing the cover outside the subsea environment prior to submerging the SEM to the subsea environment.

* * * * *